United States Patent [19]

Dolan

[11] Patent Number: 5,066,000

[45] Date of Patent: Nov. 19, 1991

[54] PORTABLE MULTI-SURFACE TRACK

[76] Inventor: Francis P. Dolan, 2719 Abrams, Dallas, Tex. 75214

[21] Appl. No.: 600,449

[22] Filed: Oct. 19, 1990

[51] Int. Cl.[5] ..... A63B 1/00; A63B 3/00; A63B 23/04

[52] U.S. Cl. ..... 272/70; 272/100; 272/109

[58] Field of Search ..... 272/70, 100, 109, 63, 272/3, 56.5 SS; 434/255

[56] References Cited

U.S. PATENT DOCUMENTS

| | | | |
|---|---|---|---|
| 3,242,509 | 3/1966 | Nissen | 272/109 X |
| 3,292,612 | 12/1966 | Foss . | |
| 3,319,273 | 5/1967 | Sollin | 272/109 X |
| 3,406,617 | 10/1968 | Randazzo | 272/56.5 SS |
| 3,460,272 | 8/1969 | Pellicore . | |
| 3,606,320 | 9/1971 | Erwin, Jr. . | |
| 3,634,895 | 1/1972 | Childers | 272/100 X |
| 3,747,233 | 7/1973 | Berryman . | |
| 4,147,129 | 4/1979 | Ruplen | 119/29 |
| 4,179,539 | 12/1979 | Schweizer | 272/56.5 SS X |
| 4,183,552 | 1/1980 | Webster . | |
| 4,549,732 | 10/1985 | Hoffman | 272/70 |
| 4,580,777 | 4/1986 | Johnson | 272/70 |

FOREIGN PATENT DOCUMENTS

| | | | |
|---|---|---|---|
| 2641345 | 3/1977 | Fed. Rep. of Germany | 272/109 |

*Primary Examiner*—Richard J. Apley
*Assistant Examiner*—D. F. Crosby
*Attorney, Agent, or Firm*—Baker & Botts

[57] ABSTRACT

A portable multi-surface track (10) comprises a plurality of sections (12) which may be arranged to form a track for use with hospital patients and rearranged for compact storage. Casters (32) allow easy transport of the multi-surface track (12).

21 Claims, 1 Drawing Sheet

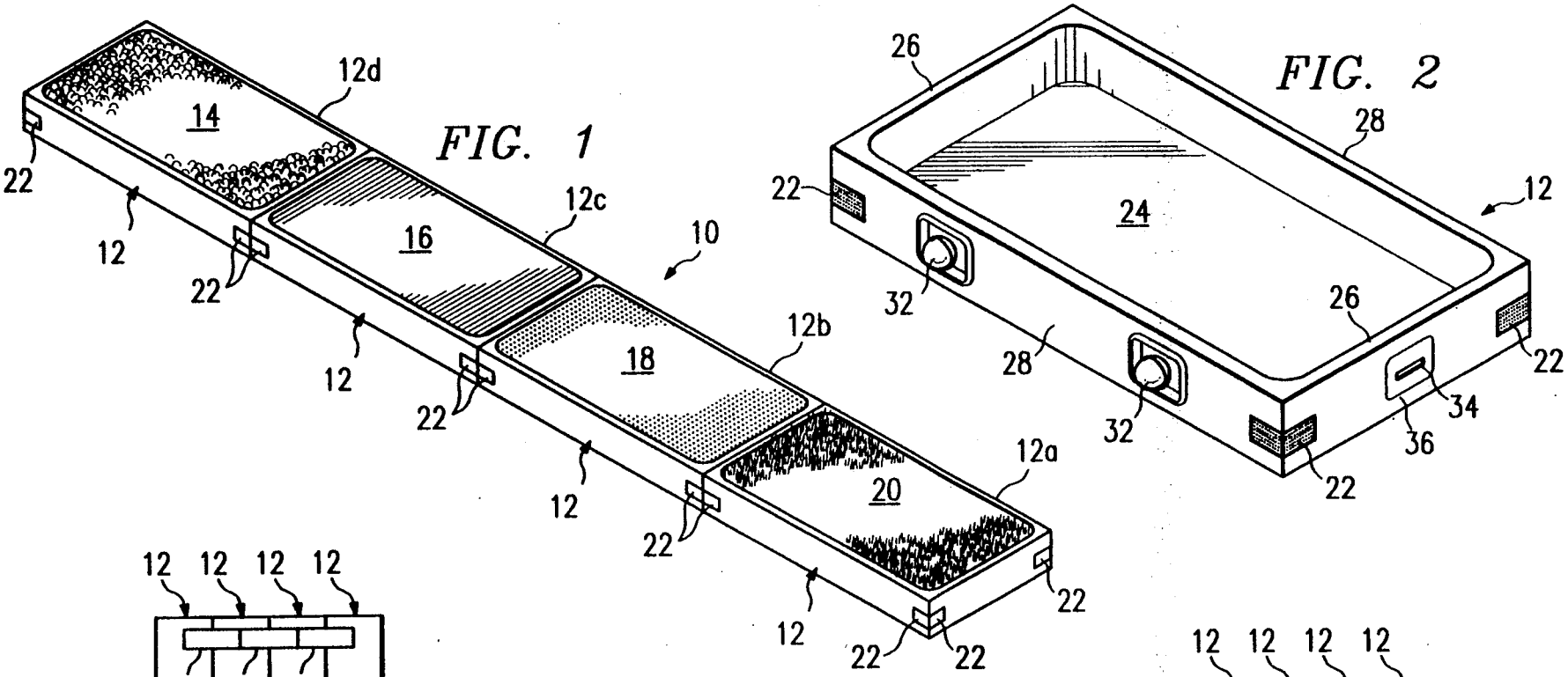
FIG. 1
FIG. 2
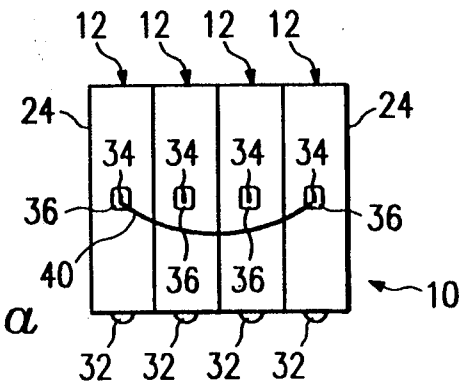
FIG. 3a
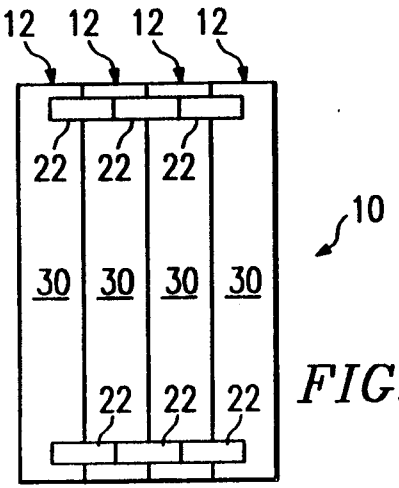
FIG. 3b

PORTABLE MULTI-SURFACE TRACK

TECHNICAL FIELD OF THE DISCLOSURE

This invention relates in general to rehabilitation devices, and more particularly to a portable track to provide varied kinesthetic input to a user's feet while walking.

BACKGROUND OF THE DISCLOSURE

A number of hospital patients may have balance difficulties, particularly when changing surfaces. These patients include those with traumatic brain injuries, C.V.A.'s, incomplete spinal cord injuries, disease states which impair lower extremities sensation, vestibular diseases, and older patients with decreased 2° sensation aging and a history of falling. In many cases, these patients may be retrained to walk again with the aid of a physical therapist.

Currently, permanent tracks are used by physical therapists in hospitals and clinics to provide the training on different surfaces. These tracks require at least a 20 foot by 2½ foot space. Accordingly, most of these tracks are built outside where space is available. However, since most clinics, rehabilitation hospitals, and acute care hospitals have limited treatment areas and cannot give up the treatment space to install a permanent track, there are a limited number of facilities which can provide the therapy needed to retrain a patient with this type of balance problem. Further, the outdoor tracks can only be used in fair weather. Thus, in many parts of the country, an outdoor track is useful for only six to eight months of the year.

Therefore, a need has arisen for a multi-surface track which may be used indoors without a large space requirement or a large expense.

SUMMARY OF THE DISCLOSURE

In accordance with the present invention, a multi-surface track is provided which substantially eliminates or prevents the disadvantages and problems associated with prior multi-surface tracks.

In the present invention, a multi-surface track is provided which includes a plurality of holding sections, each holding section having a surface associated therewith. Transporting apparatus is associated with at least one of the holding sections for allowing the holding sections to be moved and stored.

This aspect of the invention provides significant technical advantages over prior multi-surface tracks. The multi-surface track of the present invention may be stored while not in used, thereby freeing up valuable space. Further, the present invention may be made from inexpensive materials, thereby reducing the cost.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 illustrates a perspective view of the portable multi-surface track of the present invention, wherein the track is configured for use by patients;

FIG. 2 illustrates a perspective view of one section of the multi-surface track of the present invention; and FIGS. 3*a–b* illustrate side and top views of the multi-surface track of the present invention when configured for transport and storage.

DETAILED DESCRIPTION OF THE DISCLOSURE

The preferred embodiment of the present invention is best understood by referring to FIGS. 1–3 of the drawings, like numerals being used for like and corresponding parts of the various drawings.

FIG. 1 illustrates a perspective view of the multi-surface track of the present invention in a configuration operable to train patients with balance problems. The multi-surface track 10 comprises four sections 12, individually referenced as sections 12*a–d;* in practice, any number of sections could be provided, depending upon the number of surfaces desired. Each section 12 contains a different surface which may have a different texture and/or density. Section 12*a* contains an artificial turf surface 14 which is preferably disposed over a contoured styrofoam base. Section 12*b* contains a medium T-foam surface 16, which is a sponge-like material which may be used to duplicate the feel of sand. Section 12*c* contains a solid plastic surface 18 and section 12*d* contains a deep pile carpet surface 20 over an extra thick carpet pad. The sections are held together by connectors 22 which are disposed on the corners of each section 12 such that the sections may be connected lengthwise in any order. Connectors 22 may comprise any one of the number of suitable fasteners. For example, connectors 22 may comprise a hook-and-loop material, such as Velcro, or may comprise interlocking hinges disposed on a adjacent sections 12, such that the hinges may be fixedly connected by disposing a hinge rod therethrough. It should be noted that the particular surfaces illustrated are shown for reference, and are not meant to be exclusive of any other surface which may be desirable.

In operation, the sections 12 are arranged in a desired order and the connectors 22 are secured such that the sections 12 are held in the proper relation to one another. After arranging the sections 12, the patient may be guided along the track in order to practice his or her walking and balance skills.

FIG. 2 illustrates perspective and side views of a single section 12. Each section 12 comprises a base 24, short sides 26 and long sides 28. One of the long sides 28 of each section 12 has casters 32 or another rolling device, disposed therein. Preferably, the casters 32 are recessed within the long side 28 such that they do not protrude to an extent which may cause injury to a person. On the short sides 26 of the section, hooks 34 are provided within a recess 36. The hooks are used for transporting the sections as shown in greater detail in connection with FIG. 3*a*.

In the preferred embodiment, each section 12 has a 5 foot length, a 2½ foot width and a 2 inch height. The section may be fabricated from a high density plastic material, providing an integral unit. A non-skid surface is provided on the bottom of the base 24 in order to engage the floor during use.

Typically, the surface contained by the sections 12 will not require the full height of the section; in these instances, a high density styrofoam insert may be provided between the base 24 of the section 12 and the advantage that it may be easily molded into a desired contour.

In FIGS. 3*a–b*, side and top views of the multi-surface track 10 are shown in a horizontal stack configuration for transport and storage. In this configuration, sections 12 are arranged such that the sections may roll on their casters 32. A pull strap 40 is connected to one or more of the hooks 34, such that the hospital personnel may pull the sections using the strap 40. As shown in FIG. 3*b*, the sections 12 may be held together during transport using the velcro connector 22 (if Velcro is used for the connector). Other means of holding the sections 12 together may also be used, such as strapping the sections together.

Alternatively, the casters could be provided on the base 24 of one of the sections, such that they could be removed during training and replaced during transport. In this alternative, the remaining sections could be placed on top of the section with the casters to form a vertical stack.

The present invention provides several advantages over the prior art. The portable nature of the track allows clinics, rehabilitation hospitals and acute care hospitals with limited space to treat the balance problems of patients without dedicating a large area for the track. Further, since the track is easily transported, it may be used either inside or outside; therefore, the weather does not interfere with the training schedule. The portable multi-surface track can be easily assembled when needed and stored when not in use.

Although the present invention has been described in detail, it should be understood that various changes, substitutions and alterations can be made herein without departing from the spirit and scope of the invention as defined by the appended claims.

What is claimed is:

1. A multi-surface track comprising:

a plurality of holding sections, each section having a user contacting surface; at least one of said surfaces having a different texture or density than the other of said surfaces; and transporting apparatus associated with at least one of the sections for allowing the sections to be readily moved.

2. The track of claim 1 wherein said transporting apparatus includes rollers rotatably engaged in at least one of said holding sections.

3. The track of claim 2 wherein said rollers are recessed into said holding section.

4. The track of claim 1 wherein said transporting apparatus includes a strap connected to at least one of the sections for pulling the section.

5. The track of claim 1 and further comprising fastening apparatus associated with one or more of the holding sections for engaging another one of said holding sections during transport.

6. The track of claim 5 wherein said fastening apparatus comprises a hook-and-loop material disposed on portions of the sections such that they may be selectively attached to one another.

7. The track of claim 1 and further comprising fastening apparatus associated with one or more of the holding section for engaging another one of said holding sections to provide a secure connection between the sections during training.

8. The track of claim 6 wherein said fastening apparatus comprises hinges associated with said one or more sections, said hinges operable to interlock.

9. The track of claim 1 wherein one of said surfaces comprises T foam.

10. The track of claim 1 wherein said holding sections have a cavity formed therein.

11. The track of claim 10 wherein one of said surfaces includes an insert engageable in said cavity.

12. The track of claim 11 wherein said insert provides a planar surface.

13. The track of claim 11 wherein said insert provides a contoured surface.

14. The track of claim 11 wherein said base comprises a styrofoam material.

15. A multi-surface track for training a patient to walk comprising:

a plurality of holding sections, each section having a user contacting surface; at least one of said surfaces having a different texture or density than the other of said surfaces;

rolling apparatus associated with one or more of the sections for allowing easy movement of the sections; and fastening apparatus for connecting the sections such that the plurality of sections may be held together during transport and for connecting the plurality of sections during training.

16. A method of training a patient on a multi-surface track comprising the steps of:

arranging a plurality of holding sections each having a user contacting surface in a desired order; at least one of said surfaces having a different texture or density than the other of said surfaces;

connecting the sections together in said desired order;

walking the patient across the surfaces; and stacking the sections for storage.

17. The method of claim 16 wherein said stacking step comprises the step of stacking the sections horizontally.

18. The method of claim 17 wherein said step of stacking includes the step of stacking the sections such that transports apparatus associated with at least one of the sections is positioned to allow transport of the stack.

19. The method of claim 16 and further comprising the step of holding the sections together after stacking.

20. The method of claim 19 wherein said holding step comprises the step of holding the sections together using a hook-and-loop material.

21. The method of claim 16 and further comprising the step of transporting the sections.

* * * * *